United States Patent [19]

Takamiya et al.

[11] Patent Number: 4,558,906

[45] Date of Patent: Dec. 17, 1985

[54] SHIELD MACHINE

[75] Inventors: Shigeo Takamiya; Toshio Furuta, both of Tokyo, Japan

[73] Assignee: Mitsui Kensetsu Kabushiki Kaisha, Tokyo, Japan

[21] Appl. No.: 554,364

[22] Filed: Nov. 22, 1983

[30] Foreign Application Priority Data

Dec. 3, 1982 [JP] Japan ..... 57-211354
Dec. 3, 1982 [JP] Japan ..... 57-211355

[51] Int. Cl.[4] ..... F21C 29/02

[52] U.S. Cl. ..... 299/31; 299/33; 299/56; 405/146; 405/141; 405/147; 405/150

[58] Field of Search ..... 299/31, 33, 11, 58, 299/56; 405/146, 141, 147, 144, 138, 150; 175/61

[56] References Cited

U.S. PATENT DOCUMENTS

| | | | |
|---|---|---|---|
| 727,799 | 5/1903 | Hough | 405/147 |
| 1,296,312 | 3/1919 | O'Rourke | 405/147 |
| 3,410,098 | 11/1968 | Winberg | 405/147 |
| 3,494,136 | 2/1970 | Wilms | 405/147 |
| 3,698,768 | 10/1972 | Delli-Gatti | 299/55 |
| 3,830,545 | 8/1974 | Sugden | 299/56 |

FOREIGN PATENT DOCUMENTS

| | | | |
|---|---|---|---|
| 1165815 | 10/1969 | United Kingdom | 405/141 |

OTHER PUBLICATIONS

Publication entitled, "Explanation of Shield Driving Process for Enlargement," Jul., 1982, Kensetsu & Kaisha.

*Primary Examiner*—Stephen J. Novosad
*Assistant Examiner*—Michael Goodwin
*Attorney, Agent, or Firm*—Birch, Stewart, Kolasch & Birch

[57] ABSTRACT

A shield machine for enlarging a portion of an existing tunnel includes an inner and outer double cylinder shaped shield machine body with a cylindrical outer shield portion and a cylindrical inner guide portion designed to be driven in an axial direction of an existing tunnel and along an outer circumferential surface of primary assembly segments lining the existing tunnel. Jack members are provided for pushing forward the shield machine body by receiving a reaction from a reaction member such as secondary assembly segments lining a constructed enlarged tunnel. A scraper member is positioned adjacent to the inner guide portion for removing a back-filling agent on the outer surface of the primary assembly segments.

10 Claims, 5 Drawing Figures

SHIELD MACHINE

BACKGROUND OF THE INVENTION

1. Field of the Invention

This invention relates to a shield machine used for making an enlarged tunnel by enlarging a portion of an existing tunnel and more particularly to a shield machine for removing back-filling material from a segment of a previously constructed, existing tunnel for facilitating a forward driving of a shield machine body.

2. Description of Background Art

In a process for enlarging a portion of an existing tunnel, a shield machine has been hithertofore known wherein its cutter head size is changed in the midst of the existing tunnel. In another process, after the excavation of an existing tunnel is completed, a shaft may be excavated from the ground surface thereto and an enlarged portion of the tunnel may be constructed by digging and utilizing this shaft.

However, these processes are low in efficiency and problematical in increasing the working time and cost.

SUMMARY AND OBJECTS OF THE INVENTION

For removing the above defects, the present inventors have previously proposed an enlarging shield driving process and a shield machine used for the same. The proposed shield machine is of the type wherein an inner and outer double cylinder-shaped shield machine body comprises a cylindrical outer shield portion and a cylindrical inner guide portion which are adapted to be driven forward in the axial direction of an existing tunnel and along an extend surface of primary assembly segments lining the existing tunnel. The machine is provided with jack means serving to drive forward the shield machine body by a reaction force against a reaction member such as secondary assembly segments lining the enlarged tunnel. By using this machine, an enlarged tunnel portion can be constructed in a portion of the existing tunnel, without necessity of excavating the shaft, so that there is brought about such an advantage that the work becomes high in efficiency and low in cost.

This invention has for its object to provide a shield machine used for making an enlarged tunnel which is capable of removing a back-filling agent on an outer surface of primary assembly segments for facilitating forward driving of a shield machine body.

For achieving this object, it is the gist of this invention that it is provided, in front of the guide portion thereof, with a scraper means for removing a back-filling agent on an outer surface of primary assembly segments.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
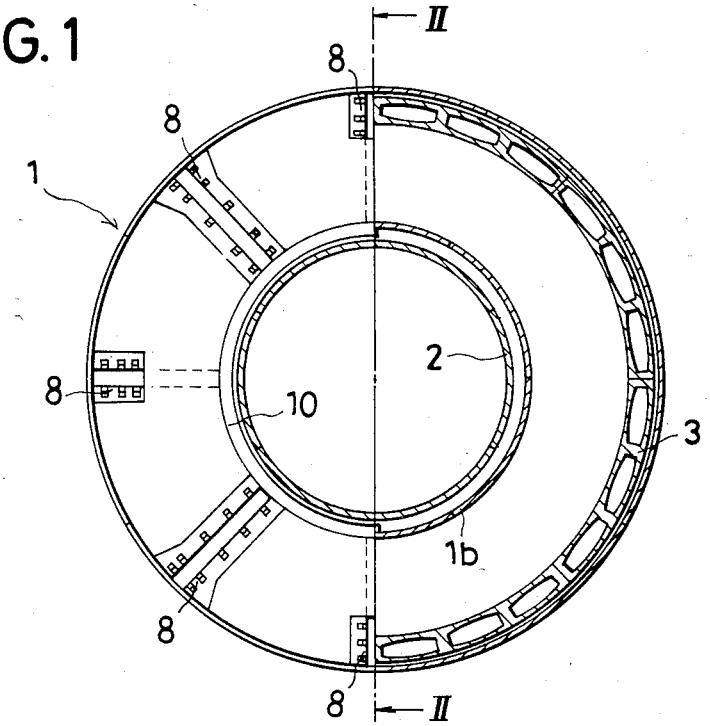
FIG. 1 is a front view, partly in section, of one embodying example of the shield machine according to the present invention.
Figure 2:
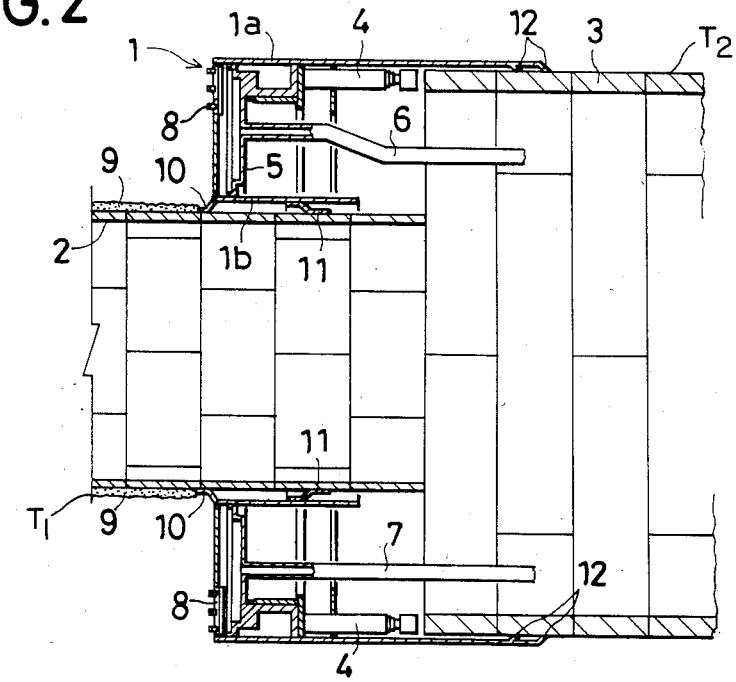
FIG. 2 is a sectional view taken along the line II—II in FIG. 1.
Figure 3:
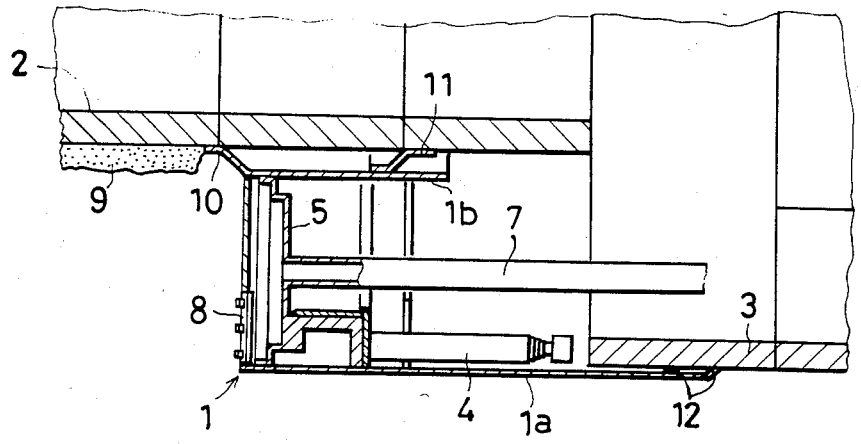
FIG. 3 is an enlarged sectional view of an important portion thereof.

Embodying examples of the present invention will be explained with reference to the accompanying drawings wherein a shield machine body 1 is adapted to be driven forward in the axial direction of an existing tunnel along an external surface of existing primary assembly segments of a cylindrical form lining the existing tunnel $T_1$. As illustrated in FIGS. 1 and 2, the shield machine body 1 includes an inner and outer double cylinder. An outer cylindrical shield portion 1*a* is disposed around an inner cylindrical guide portion 1*b*. The inner cylindrical guide portion 1*b* is positioned at a forward portion of the interior space of the outer shield portion 1*a*. Jack means comprising a plurality of annularly arranged jacks 4, 4 . . . 4 provide a drive force for driving forward the shield machine body 1 by utilizing a reaction force from a reaction member such as a secondary assembly segment 3 lining an enlarged tunnel portion $T_2$. The secondary assembly segment 3 is constructed on the periphery of a portion of the foregoing existing tunnel $T_1$ and is disposed on an inner surface of the shield portion 1*a*.

A partition wall 5 in an annular form extending between the shield portion 1*a* and the guide portion 1*b* is provided in front of the shield machine body 1. The partition wall 5 is provided with an inlet pipe 6 and an outlet pipe 7. A crusher means 8, such as a rotary cutter which serves to crush a facing, is provided in front of the partition wall 5.

When the facing is soft, it is sufficient to provide only the partition wall 5 having a soil discharging hole. It is also possible to omit the wall 5 and the pipes 6, 7, and provide only the crusher means 8 such as the rotary cutter, a screw auger or the like. In addition, it is possible to also omit the crusher means so that the facing may be dug manually.

According to the present invention, a scraper means 10 for removing a back-filling agent 9, such as mortar or the like already applied to the outer surface of the primary assembly segments 2, is provided in front of the guide portion 1*b*.

The scraper means 10 is in the form of a ring surrounding the whole circumference of the primary assembly segments 2 and is provided in front of the guide portion 1*b* so as to be integral therewith. The scraper means 10 can also serve as a part of the guide portion 1*b*. Further, the same may be so modified into a stepped ring such that the rear stage ring thereof is smaller in diameter than the front stage for scraping the back-filling agent in two stages.

The guide portion 1*b* is provided at its inner circumferential surface with a rubber made inner seal member 11 for sealing a gap formed between the inner circumferential surface of the guide portion 1*b* and an outer circumferential surface of the primary assembly segments 2. The shield portion 1*a* is provided at its rear end portion with inner seal members 12, 12 for sealing a gap formed between the inner circumferential surface of the shield portion 1*a* and the outer circumferential surface of the secondary assembly segments 3. The seal members 11, 12 are formed to prevent crushed earth and sand or scraped back-filling agent from entering the shield machine body 1.

Figure 4:
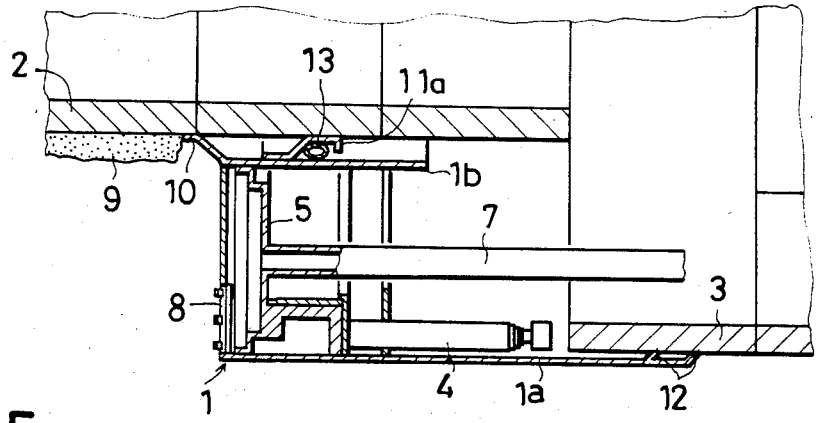
FIGS. 4 and 5 are enlarged sectional views of important portions of modified examples of FIG. 3.

FIG. 4 illustrates an improved sealing arrangement. In addition to the inner seal member 11, an air bag type ring packing 13 serving as a seal member is provided on the inner circumferential surface of the guide portion 1*b* so as to be interposed between the seal member 11 and the guide portion 1*b*. When the shield machine body 1 is intended to be driven forward, the inflated air in the packing 13 is evacuated for a smooth forward movement of the shield machine body 1. A stopper 11*a* is formed at the rear portion of the inner seal member 11 so as to retain the packing 13.

Figure 5:
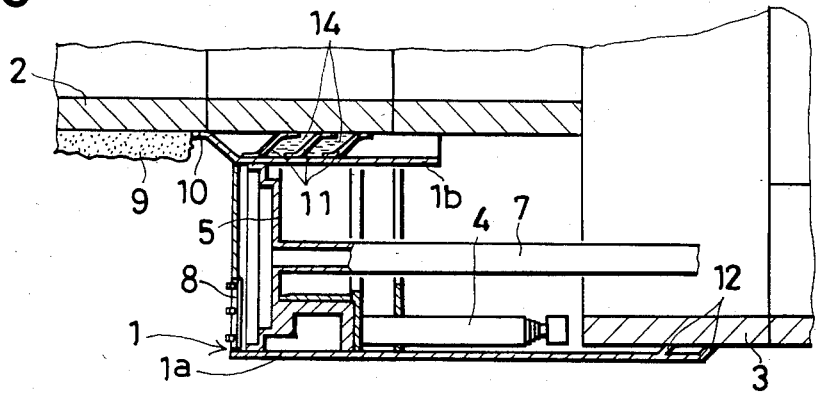

As illustrated in FIG. 5, the packing 13 is replaced with a plurality of inner seal members 11, 11 . . . 11 provided at space intervals with grease 14 filling each space therebetween.

Of course, although not illustrated, additional seal member such as the packing 13 and the grease 14 may be utilized for sealing the gap formed between the inner circumferential surface of the shield portion 1*a* and the outer circumferential surface of the secondary assembly segments 3.

When the enlarged tunnel portion $T_2$ is to be constructed by using the foregoing shield machine, the shield machine is assembled at a starting base formed in a portion of the existing tunnel $T_1$ by any desired method. The facing is crushed by operation of the rotary cutter 8, and the crushed earth and soil are fluidized by water charged through the inlet pipe 6 and pumped out from the outlet pipe 7. During this operation, the shield machine body is driven forward by the jack means 4 receiving a reaction force from a reaction plate provided at the starting base. The enlarged tunnel portion $T_2$ thus constructed is lined therearound with secondary assembly segments 3 in the form of a ring by an erector (not illustrated). Thereafter, the shield machine is further driven by the jack means 4 receiving a reaction from the secondary assembly segments 3. The forward driving of the shield machine and the construction of the enlarged tunnel $T_2$ lined with the secondary assembly segments 3 are repeated in the same manner as discussed above. In the meanwhile, the excavation of the enlarged tunnel $T_2$ is advanced, the primary assembly segments 2 comprising a series of ring assemblies are removed.

The outer surface of the primary assembly segments 2 normally includes a back-filling agent 9, such as mortar or the like for the purpose of reinforcement. Thus, it often occurs that a smooth driving of the shield machine body during the above enlarged tunnel making operation is obstructed by the back-filling agent 9. According to the present invention, the shield machine is provided with the scraper means 10 for removing the back-filling agent 9 in front of the guide portion 1*b* thereof. In this manner, the back-filling agent 9 can be removed automatically as the shield machine body 1 is driven forward. Consequently, a smooth tunnelling operation can be carried out.

Thus, according to this invention, a shield machine body 1 is provided in front of a guide portion 1*b* thereof with a scraper means for removing a back-filling agent on primary assembly segments so that an enlarged tunnel portion can be constructed in a portion of the existing tunnel.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A shield machine for enlarging a portion of an existing tunnel comprising:

an inner and outer double cylinder shaped shield machine body including a cylindrical outer shield portion and a cylindrical inner guide portion adapted to be driven in an axial direction of an existing tunnel and along an outer circumferential surface of primary assembly segments lining the existing tunnel;

jack means for pushing forward the shield machine body by receiving a reaction force from a reaction member such as secondary assembly segments lining a constructed enlarged tunnel; and a scraper means being positioned in front of the inner guide portion for removing a back-filling agent on said outer surface of said primary assembly segments before those segments are removed.

2. A shield machine according to claim 1, wherein a partition wall is provided extending between the shield portion and the guide portion in front of the shield machine body, said partition wall includes an inlet pipe and an outlet pipe operatively connected thereto.

3. A shield machine according to claim 2, wherein a crusher means is provided in front of the partition wall for crushing material positioned between said outer shield portion and said inner guide portion.

4. A shield machine according to claim 3, wherein said crusher means is a screw auger.

5. A shield machine according to claim 3, wherein said crusher means is a rotary cutter.

6. A shield machine according to claim 1, wherein an inner circumferential surface of the guide portion adapted to be brought into sliding contact with the primary assembly segments is provided with a seal member for sealing a gap formed between the inner circumferential surface of the guide portion and the outer circumferential surface of the primary assembly segments.

7. A shield machine according to claim 4, wherein an inner circumferential surface of the shield portion adapted to be brought into sliding contact with the secondary assembly segments is provided with a seal member for sealing a gap formed between the inner circumferential surface of the shield portion and the outer circumferential surface of the secondary assembly segments.

8. A shield machine according to claim 6, wherein said seal member is an air bag ring being inflatable to provide a seal between the inner circumferential surface of the guide portion and the outer circumferential surface of the primary assembly segments.

9. A shield machine according to claim 6, wherein said seal member is a plurality of inner seal members spaced relative to each other and including grease being positioned therebetween.

10. A shield machine according to claim 2, wherein fluid is supplied to said inlet pipe and fluidized material is discharged from said outlet pipe.

* * * * *